US009818389B2

(12) United States Patent
Beers

(10) Patent No.: US 9,818,389 B2
(45) Date of Patent: Nov. 14, 2017

(54) GUITAR PICKUP DEVICE AND METHOD

(71) Applicant: Garry W. Beers, Studio City, CA (US)

(72) Inventor: Garry W. Beers, Studio City, CA (US)

( * ) Notice: Subject to any disclaimer, the term of this patent is extended or adjusted under 35 U.S.C. 154(b) by 0 days.

(21) Appl. No.: 15/269,322

(22) Filed: Sep. 19, 2016

(65) Prior Publication Data

US 2017/0162180 A1 Jun. 8, 2017

Related U.S. Application Data

(60) Provisional application No. 62/220,084, filed on Sep. 17, 2015.

(51) Int. Cl.

| | |
|---|---|
| ***G10H 3/18*** | (2006.01) |
| ***G10H 3/14*** | (2006.01) |
| ***G10H 1/08*** | (2006.01) |
| ***G10H 1/46*** | (2006.01) |

(52) U.S. Cl.

CPC ..... *G10H 3/182* (2013.01); *G10H 1/08* (2013.01); *G10H 1/46* (2013.01); *G10H 3/181* (2013.01); *G10H 3/183* (2013.01); *G10H 2220/515* (2013.01)

(58) Field of Classification Search

CPC ..... G10H 3/183; G10H 3/181
USPC ..... 84/727
See application file for complete search history.

(56) References Cited

U.S. PATENT DOCUMENTS

| | | | | | |
|---|---|---|---|---|---|
| 4,348,930 | A * | 9/1982 | Chobanian | G10H 3/182 | 84/726 |
| 4,524,667 | A * | 6/1985 | Duncan | G10H 3/181 | 84/728 |
| 5,136,919 | A * | 8/1992 | Wolstein | G10H 1/08 | 84/735 |
| 6,121,537 | A * | 9/2000 | Pawar | G10H 3/182 | 84/728 |
| 7,115,810 | B2 * | 10/2006 | Ambrosino | G10H 1/18 | 84/742 |
| 7,208,673 | B2 * | 4/2007 | Bryce | G10H 3/182 | 84/726 |
| 7,427,710 | B2 * | 9/2008 | Hara | G10H 3/182 | 84/723 |
| 7,982,123 | B2 * | 7/2011 | Mulvany | G10H 3/181 | 84/725 |
| 7,989,690 | B1 * | 8/2011 | Lawing | G10H 3/181 | 84/723 |
| 8,319,088 | B1 * | 11/2012 | Harari | G10H 3/181 | 84/727 |

(Continued)

FOREIGN PATENT DOCUMENTS

| | | |
|---|---|---|
| GB | 2462378 | 11/2002 |
| JP | 04125594 A | 4/1999 |
| JP | 3851169 B2 | 11/2006 |

*Primary Examiner* — David Warren
*Assistant Examiner* — Christina Schreiber
(74) *Attorney, Agent, or Firm* — Cislo & Thomas, LLP; Kelly W. Cunningham

(57) ABSTRACT

A pickup for a guitar that has four (4) or more separate magnetic coils and selection means to select among the coil outputs. In some embodiments, the pickup is passive, not requiring an active pre-amplifier and voltage supply to shape the sound. In some embodiments, the selection means may be incremental or continuous, providing a wider degree to selectivity between and among the outputs of the separate coils.

6 Claims, 17 Drawing Sheets

(56) References Cited

U.S. PATENT DOCUMENTS 8,324,495 B2 * 12/2012 Jacob ..... G10H 1/18 84/741
8,664,507 B1 * 3/2014 Lawing ..... G10H 3/143 84/723
8,907,199 B1 * 12/2014 Dixon ..... G10H 3/181 84/726
8,969,701 B1 * 3/2015 Dixon ..... G10H 3/143 84/723
9,401,134 B2 * 7/2016 Baker ..... G10H 3/22
2002/0083819 A1 * 7/2002 Kinman ..... G10H 3/181 84/726
2004/0107822 A1 * 6/2004 Olvera ..... G10H 3/182 84/743
2006/0011051 A1 * 1/2006 Aivbrosino ..... G10H 1/18 84/742
2007/0251374 A1 * 11/2007 Armstrong-Muntner ..... G10H 3/182 84/735
2011/0290099 A1 * 12/2011 Franklin ..... G10H 3/182 84/733
2012/0036983 A1 * 2/2012 Ambrosino ..... G10H 3/143 84/731
2012/0210848 A1 * 8/2012 Yamanaka ..... G10H 3/181 84/726
2013/0239788 A1 * 9/2013 Mills ..... G10H 3/181 84/726
2013/0327202 A1 * 12/2013 Mills ..... G10H 3/181 84/726
2014/0041514 A1 * 2/2014 Gross ..... G10H 3/181 84/726
2014/0245877 A1 * 9/2014 Gelvin ..... G10H 3/181 84/727
2015/0262568 A1 * 9/2015 Krasnov ..... G10H 3/143 84/728
2015/0317966 A1 * 11/2015 Liptac ..... G10H 1/32 84/735
2016/0027422 A1 * 1/2016 Baker ..... G10H 3/22 84/726
2016/0314775 A1 * 10/2016 Wolf ..... G10H 3/181
2017/0162180 A1 * 6/2017 Beers ..... G10H 3/181

* cited by examiner

PHOTO OF 'QUAD' 4 COIL MAGNETIC PICKUP — BOTTOM VIEW.

QUAD' PICKUP BASIC SOUND OPTIONS.

COMPLETED PICKUP ASSEMBLY BECOMES ONE PICKUP W. FOUR INDIVIDUAL COILS. THIS ENABLES MULTIPLE SOUNDS.

Quad pick up selection using push pull and pan control
5 Different sounds

P-P switch in w.pan control at center produces same result as 2 all coils on = full humbucker
=5 different sounds Smooth continuous movement of the rotary control provides a huge array of sound combinations

GARRY BEERS

USAGE 5 STRING 'QUAD' PICKUP.

SAME USAGE AS 4 STRING VERSION.

COMPLETED PICKUP ASSEMBLY BECOMES ONE PICKUP CONTAINING 4 SEPARATE COILS (2 × 2 STRING COILS, 2 × 3 STRING COILS)

THIS ENABLES PICKUP TO GET MULTIPLE SOUND OPTIONS

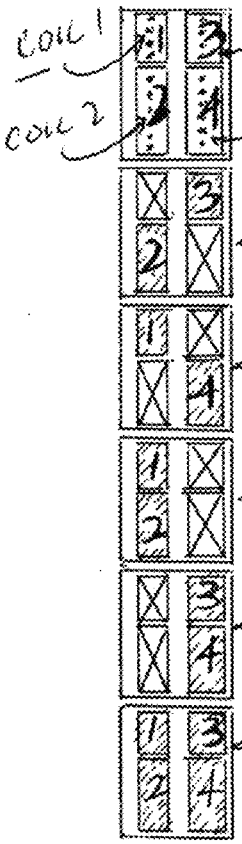

- COIL LAYOUT + NUMBERING.

☒ - DENOTES COIL OFF.

▨ - DENOTES COIL ON

OPTION ① TRADITION 'P' BASS SOUND
SPLIT HUMBUCKER SOUND
COILS 2 (3 STRINGS) + 3 (2 STRINGS)

OPTION ② 'REVERSE' 'P' BASS SOUND.
REVERSE SPLIT HUMBUCKER SOUND
COILS 1 (2 STRINGS) + 4 (3 STRINGS)

OPTION ③ SINGLE COIL 'P' BASS SOUND 1
COILS 1 (2 STRINGS) + 2 (3 STRINGS)

OPTION ④ SINGLE COIL 'P' BASS SOUND 2
COILS 3 (2 STRINGS) + 4 (3 STRINGS)

OPTION ⑤ ALL 4 COILS TOGETHER
(TRUE HUMBUCKER SOUND)
COILS 1 + 3 (2 STRINGS)
+ 2 + 4 (3 STRINGS)

FIG. 10

TWO PICKUP CONFIGURATION

PICKUP 1 - 2 COIL HUMBUCKER IN NECK POSITION OF BASS GUITAR.

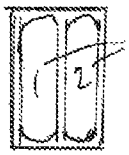

SPECS 12 KΩ TOTAL RESISTANCE
6 KΩ ea coil.
43 AWG POLYNYLON WIRE
4900 turns PER COIL.
CERAMIC + ALNICO 5 MAGNETS

PICKUP 2 - 4 COIL 'QUAD' PICKUP IN CENTER POSITION OF BASS GUITAR

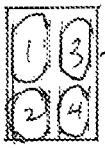

SPECS 18.37 KΩ TOTAL
9.24 KΩ SPLIT
4.61 KΩ EA COIL
43 AWG POLYNYLON WIRE
8000 turns PER COIL
CERAMIC + ALNICO 5 MAGNETS USING the 3 WAY PICKUP SELECTOR

- POSITION 1 - NECK POSITION HUMBUCKER ONLY
- POSITION 2 - (CENTER) - BOTH PICKUPS ON
- POSITION 3 - 'QUAD' PICKUP ONLY

WHEN USED IN CONJUNCTION WITH THE ROTARY PAN CONTROL FOR THE 'QUAD' PICKUP AN ALMOST INFINITE NUMBER OF SOUND COMBINATIONS ARE AVAILABLE.

SEE PAGE 17/17 FOR SOUND COMBINATIONS

FIG. 15

GUITAR PICKUP DEVICE AND METHOD

CROSS-REFERENCES TO RELATED APPLICATIONS

This patent application claims the benefit of U.S. Provisional Application No. 62/220,084, filed on Sep. 17, 2015, which is incorporated herein by this reference thereto.

BACKGROUND OF THE INVENTION

Field of the Invention

The present invention relates to vibration pickups for stringed instruments.

SUMMARY OF THE INVENTION

One embodiment of the present invention comprises a pickup for a guitar that has four (4) or more separate magnetic coils and selection means to select among the coil outputs. In some embodiments, the pickup is passive, not requiring an active pre-amplifier and voltage supply to shape the sound. In some embodiments, the selection means may be incremental or continuous, providing a wider degree of selectivity between and among the outputs of the separate coils.

BRIEF DESCRIPTION OF THE DRAWINGS

FIG. 10 is a diagram showing several varied options for the user due to arranging the magnetic coils in keeping with the four-string quad pickup of FIG. 8.

FIG. 15 is an explanation of this quad pickup plus standard pickup combination.

DESCRIPTION OF THE PREFERRED EMBODIMENTS

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
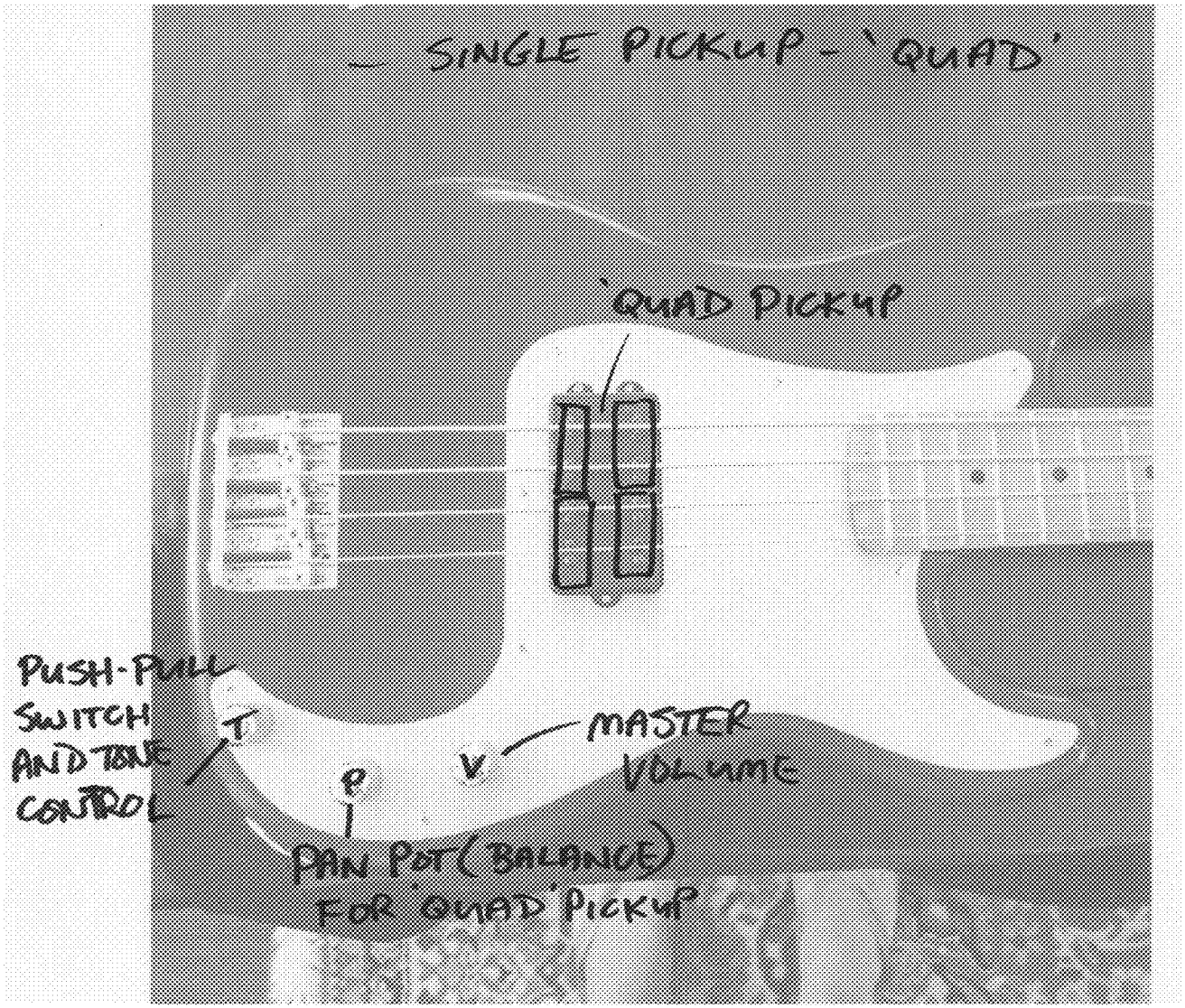
FIG. 1 is an image of a guitar body having an example of a quad pickup in keeping with one embodiment of the present invention.
Figure 2:
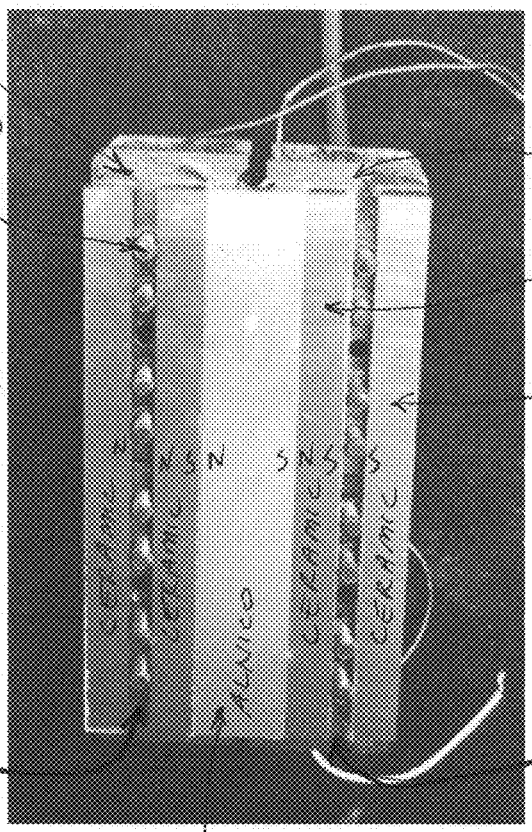
FIG. 2 is a close-up of one such quad pickup before being mounted to a guitar.
Figure 3:
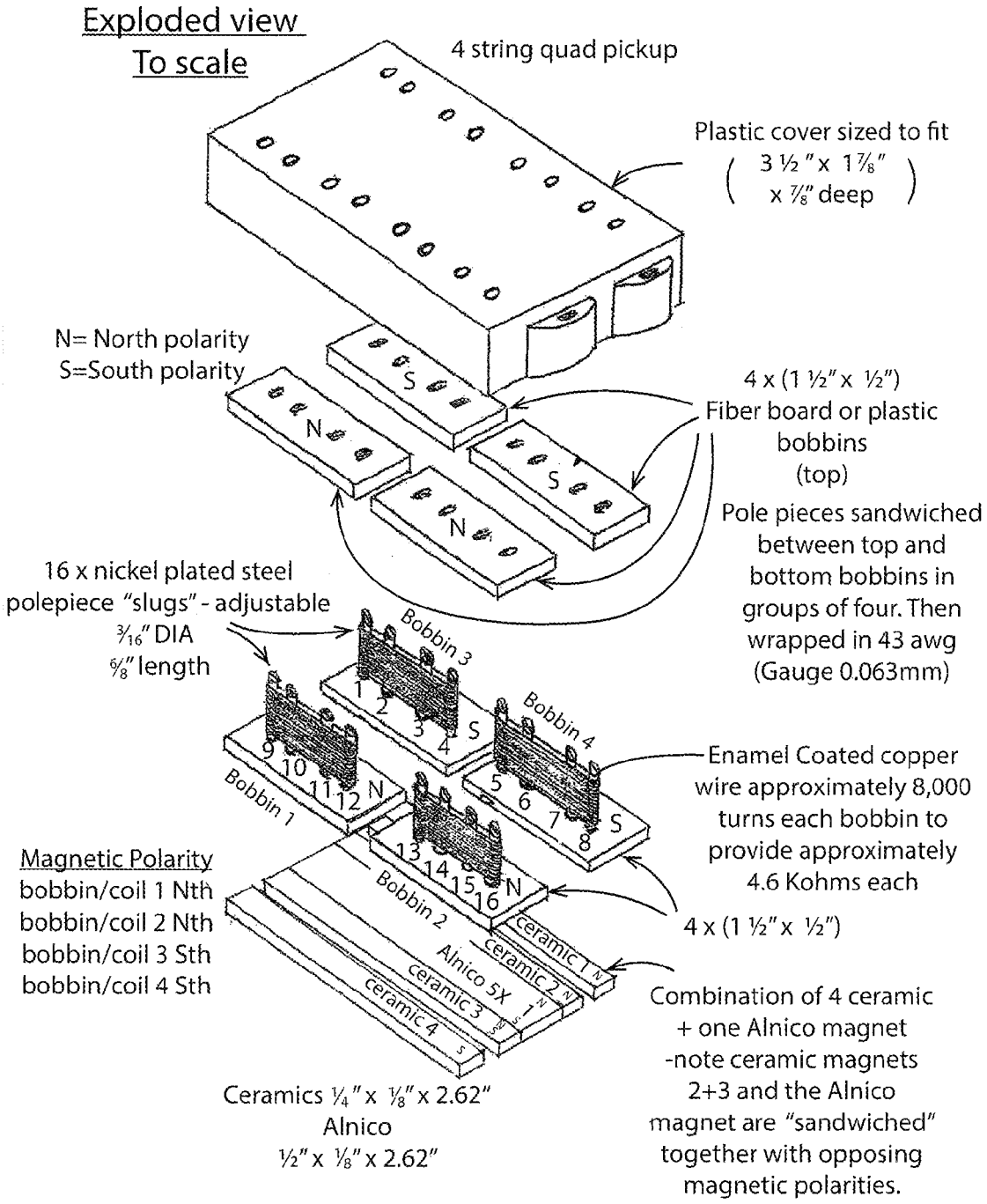
FIG. 3 is a diagram showing an exploded view of one embodiment of a four-string quad pickup of the present invention.

As shown in FIGS. 1 through 3, one embodiment of the present invention involves the use of four (4) magnetic coils. A pickup, in general, acts as a transducer for capturing mechanical vibrations and converts the vibrations to an electrical signal which can then be amplified, recorded, or broadcast. This first embodiment of the present invention is unique, making the pickup far more versatile than any prior art, a pickup having four separate magnetic coils, as shown in FIG. 3, which we will refer to herein as a "quad pickup."

In some embodiments, construction of the quad pickup is unique in its use and placement of a combination of both ceramic and Alnico (Alnico 5) magnets. When used in conjunction with a "push pull" switch and a pan (balance) control dial, the quad pickup has the ability to produce a huge array of different sounds. By just using the pan control in 3 positons—full clockwise, center, and full counter-clockwise—the quad pickup may produce five different sounds, as shown in diagram form in FIG. 8. In some embodiments, the pan control may be more incremental or offer even smooth continuous biasing over a given range. When such a pan control is used gradually moving from full clockwise to full counter-clockwise, the quad pickup can produce an almost limitless combination of the above-mentioned five sounds.

FIGS. 5 through 13 illustrate some variations that thereby allow for four-, five-, six-, seven-, and eight-string quad pickup assemblies, each may comprise four separate magnetic coils, and in each, the quad pickup assembly may be constructed with the same methods and basic technical specifications, allowing for ease of manufacture and economy of scale.

Figure 4:
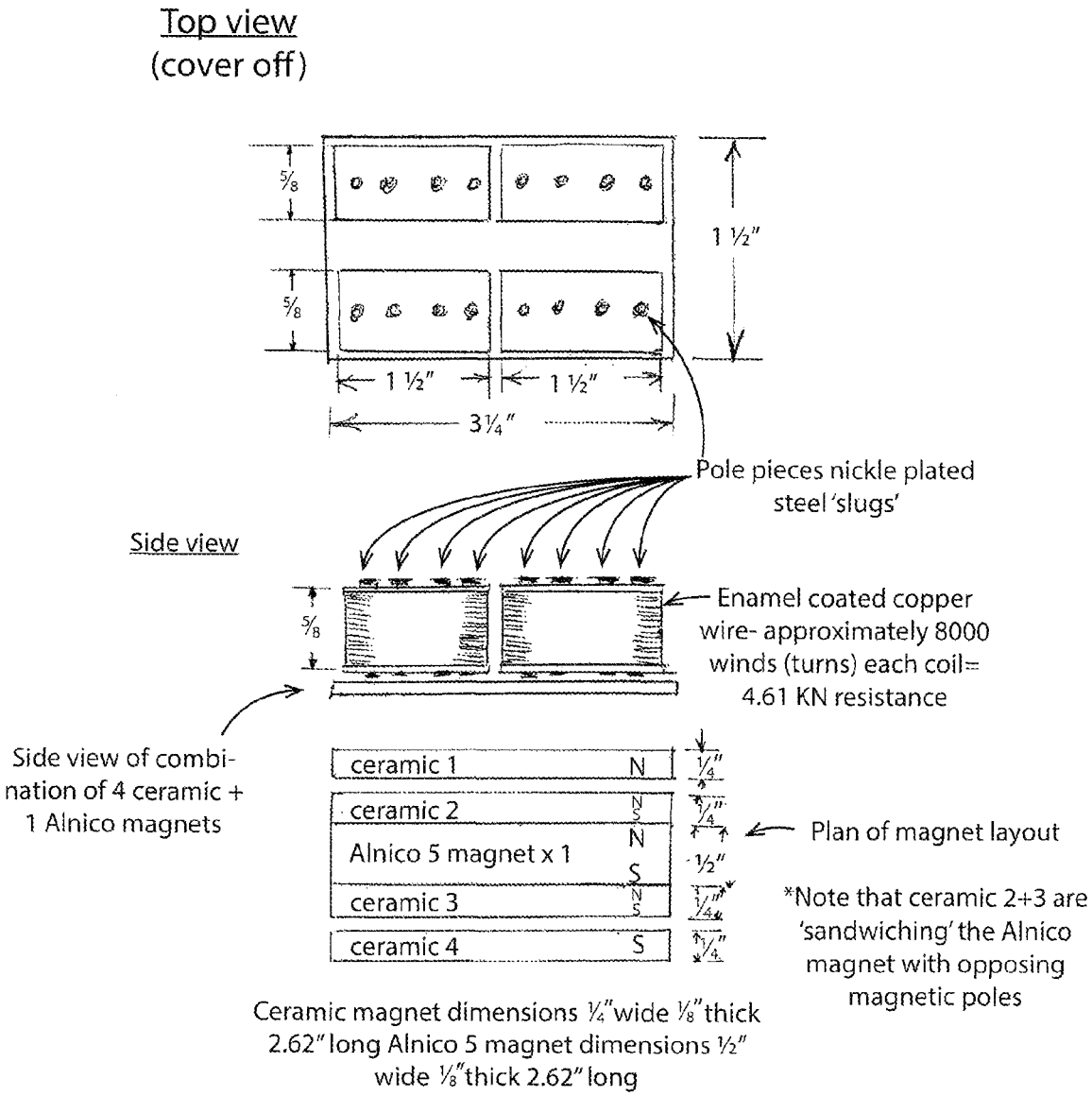
FIG. 4 is a diagram showing a top view of one embodiment of the four-string quad pickup of FIG. 3 with its plastic cover off, a side view of one embodiment of the four-string quad pickup of FIG. 3, and a bottom view of one embodiment of the four-string quad pickup of FIG. 3.
Figure 5:
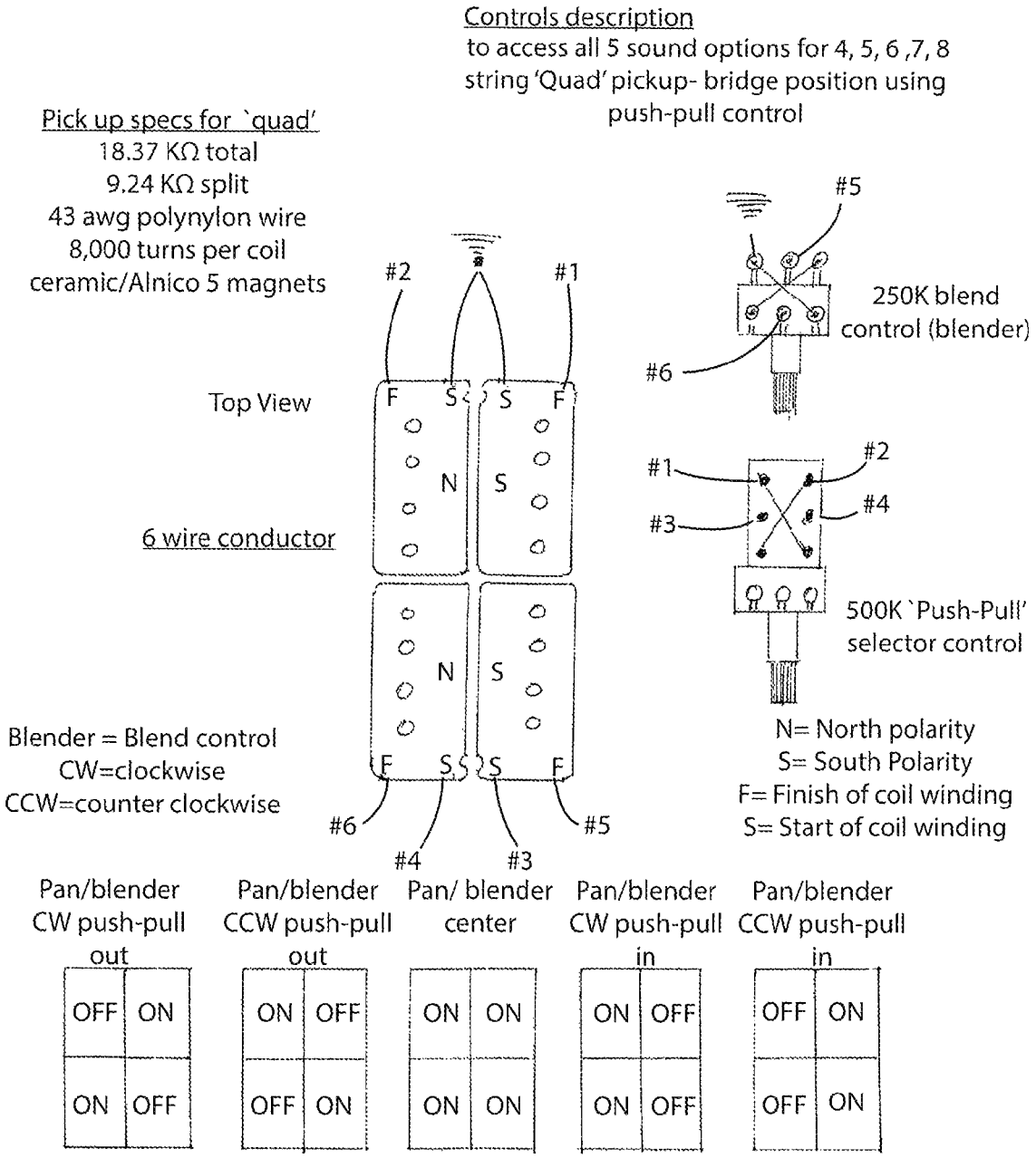
FIG. 5 is a top view of a diagram of such a quad pickup showing the electrical configuration thereof and the selection options arising therefrom.
Figure 6:
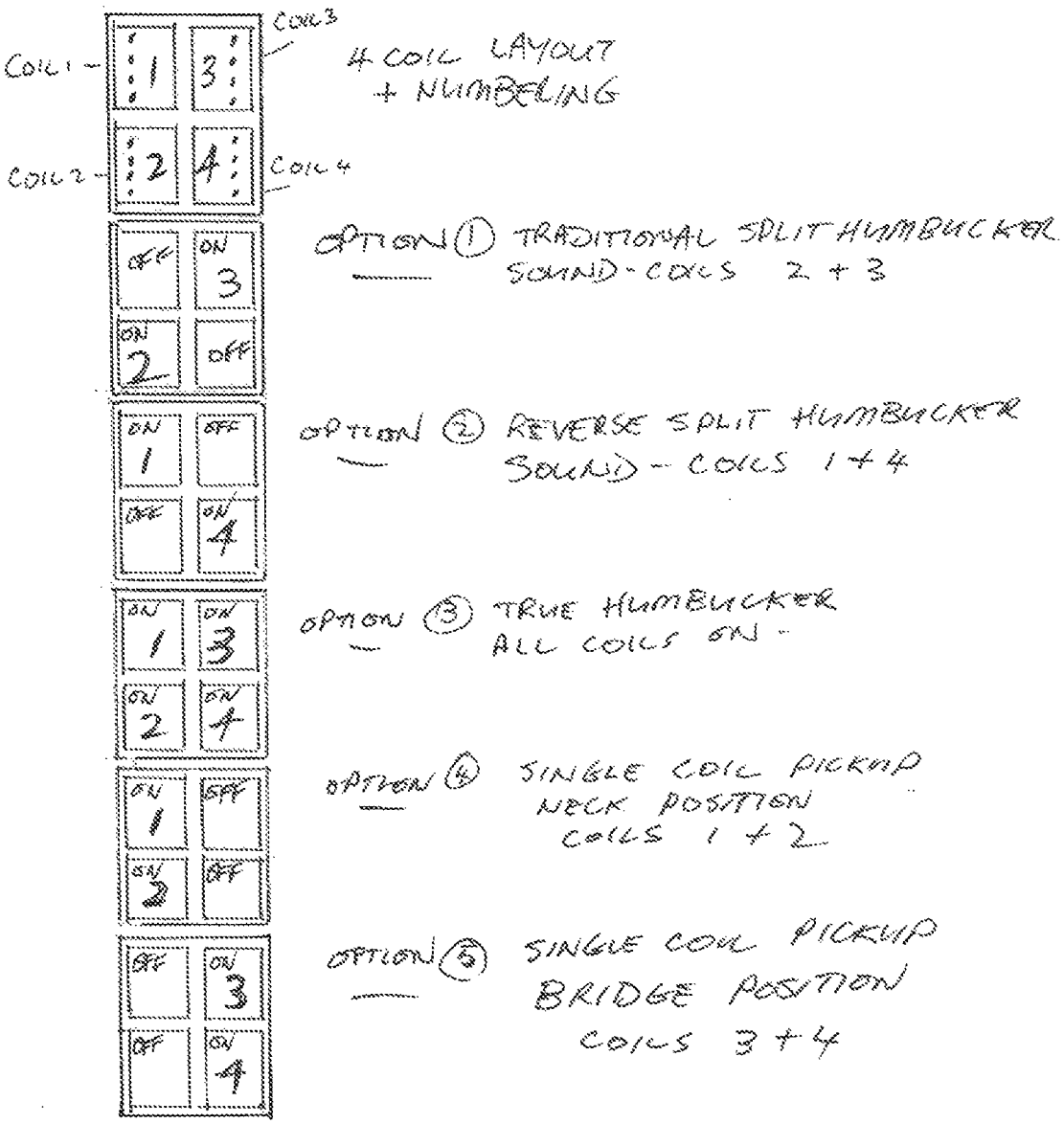
FIG. 6 is a diagram showing several varied options for the user due to arranging the magnetic coils in keeping with the four-string quad pickup of FIG. 3.
Figure 7:
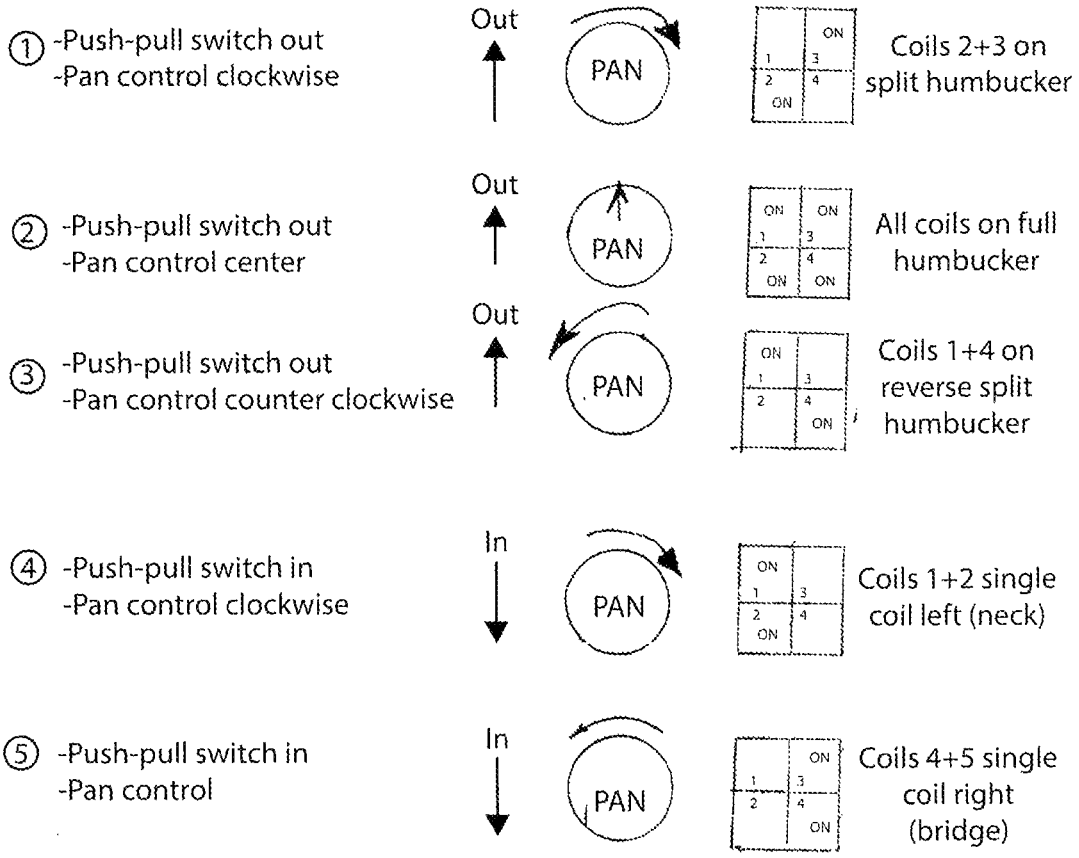
FIG. 7 is a diagram showing continuous or incremental pan controls in keeping with the four-string quad pickup of FIG. 3.

As shown in FIG. 3 through 5, such a four-string quad pickup assembly may comprise a cover, preferably plastic, covering four (4) top bobbins, preferably fiberboard or plastic. Sixteen (16) pole piece slugs, preferably of nickel-plated steel and adjustable, may be fitted on four (4) bottom bobbins in groups of four (4). Each group of four (4) pole piece slugs may be wrapped in, for example, 43 AWG (0.063 mm gauge) enamel coated copper wire, approximately 8,000 winds or turns with each bottom bobbin to provide approximately 4.61K ohm of resistance, creating four (4) separate coils (coil 1, coil 2, coil 3, and coil 4). As depicted in FIG. 5, coil 1 and coil 2 could have a North magnetic polarity and coil 3 and coil 4 could have a South magnetic polarity.

In one embodiment, the quad pickup is intended to be used as a "passive" magnetic pickup, i.e., not requiring an active pre-amplifier to shape the sound. In an "active" pickup system, the pickup requires the use of a nine volt battery or something similar to power an electronic system to amplify and shape the sound of the device, creating the sound—in this case, a magnetic pickup that picks up the instrument's string vibrations. The quad pickup may be configured to require no such extra electronics and may therefore be a true "passive" device that creates its own unique set of sounds and transfers the sounds directly to a simple array of controls, such as pan, volume, and tone controls.

Some embodiments incorporate a "quad 5" pickup, which enables a 5-string bass to easily replicate a split humbucker or reverse split humbucker in an easily installed passive package. The controls that accompany this design are simple: a passive 4 coil pickup mated to a push-pull switch and a rotary "blend" control to allow the bass access to a vast array of sounds. The basic five sounds that are provided by the push-pull switch are (1) the split humbucker, (2) the reverse split humbucker, (3) the full humbucker, (4) the single coil left side, and (5) the single coil right side. Adding the rotary blend control allows an almost limitless amount of sound combinations out of these five basic sounds. 5-string bass players have not had proper access to this amount of sounds from one pickup before.

The four-, five-, six-, seven-, and eight-string quad pickup assemblies illustrated and described below are specific examples of the applicant's broader inventive concept. This inventive concept equally benefits stringed instruments of other configurations and instruments comprising other numbers of strings.

Figure 14:
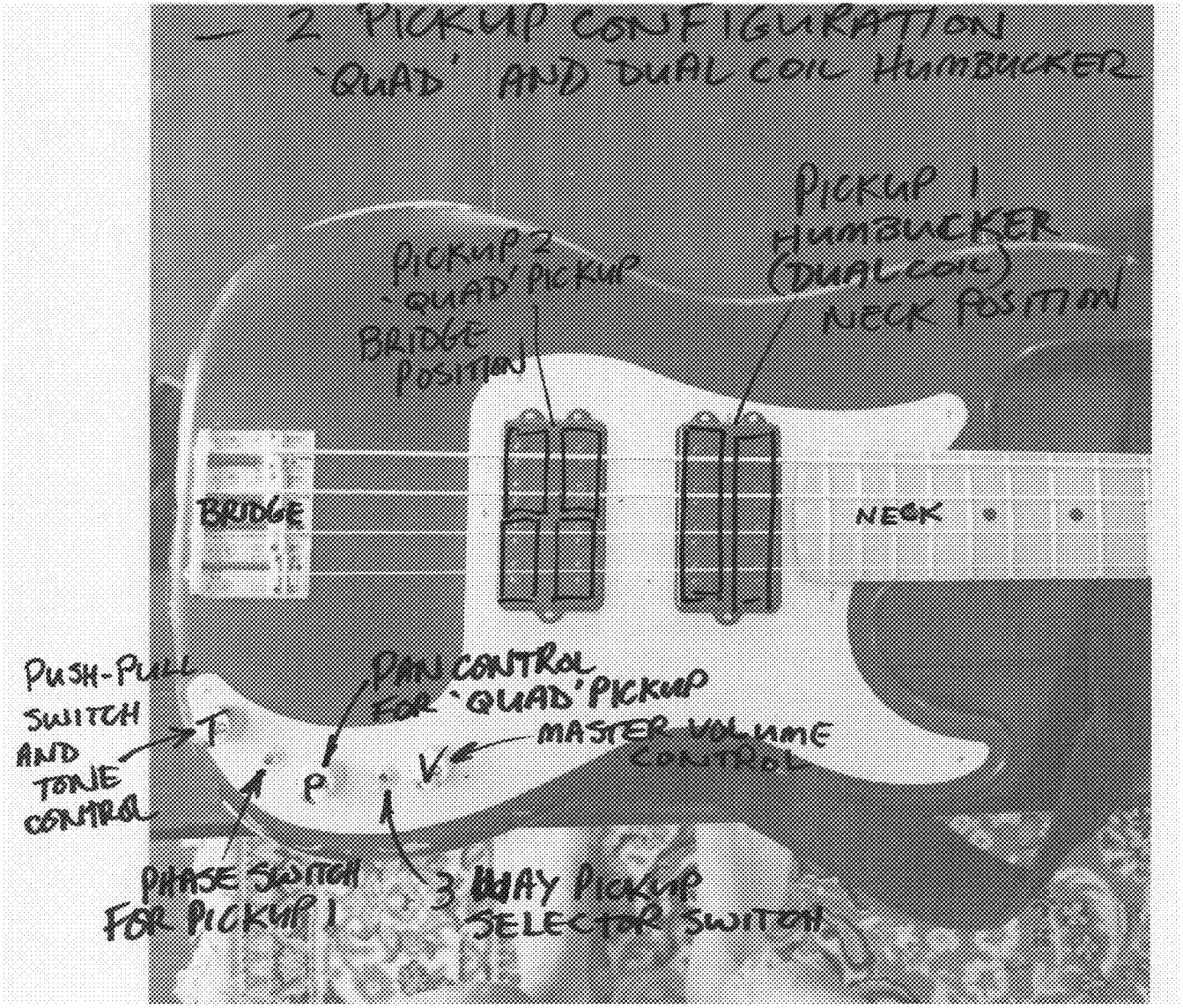
FIG. 14 is an image of a guitar body having an example of a quad pickup plus standard dual-coil pickup combination, which is also in keeping with one embodiment of the present invention.
Figure 16:
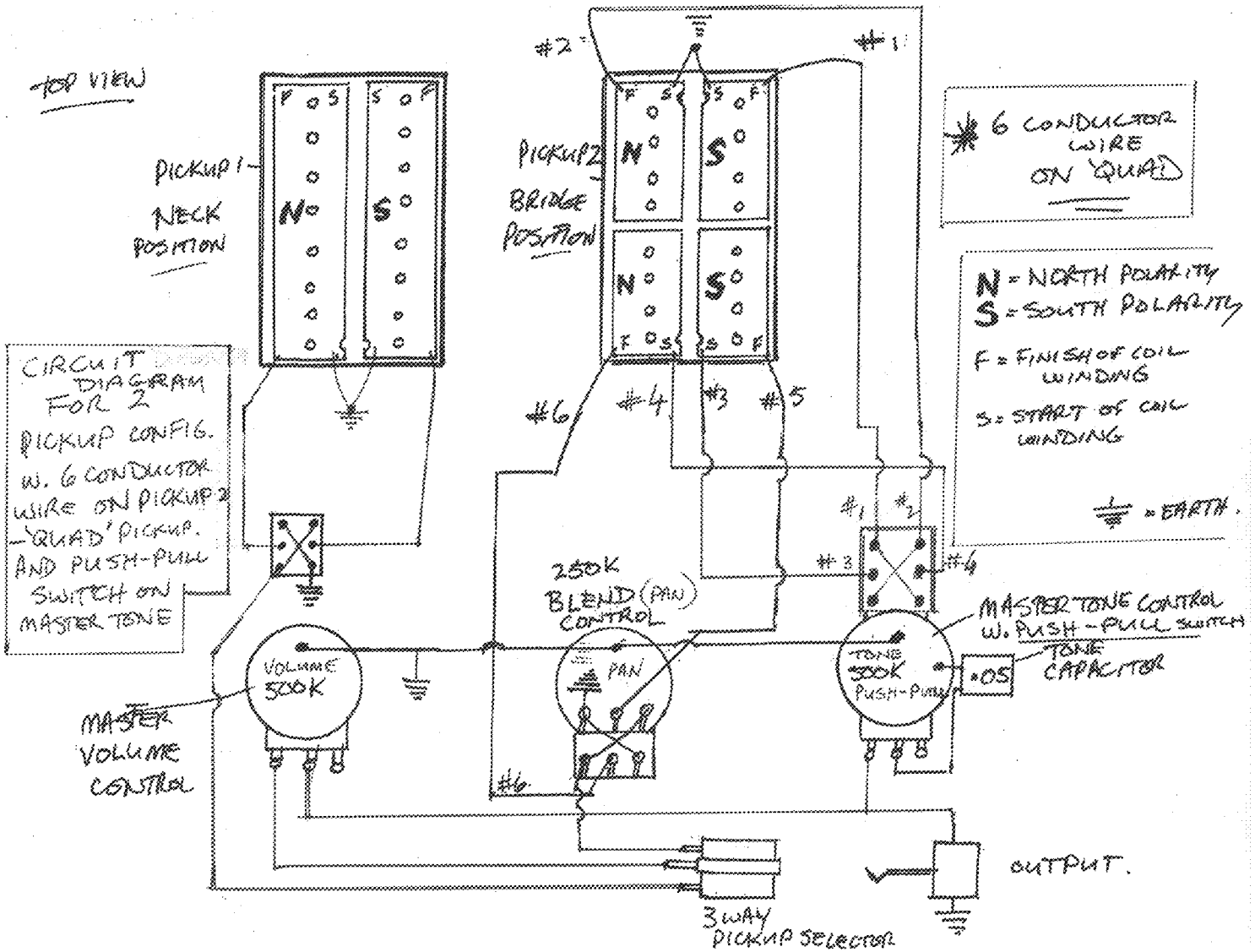
FIG. 16 is a top view of a diagram of such a quad pickup plus standard dual-coil pickup combination, showing the electrical configuration thereof and the selection options arising therefrom.
Figure 17:
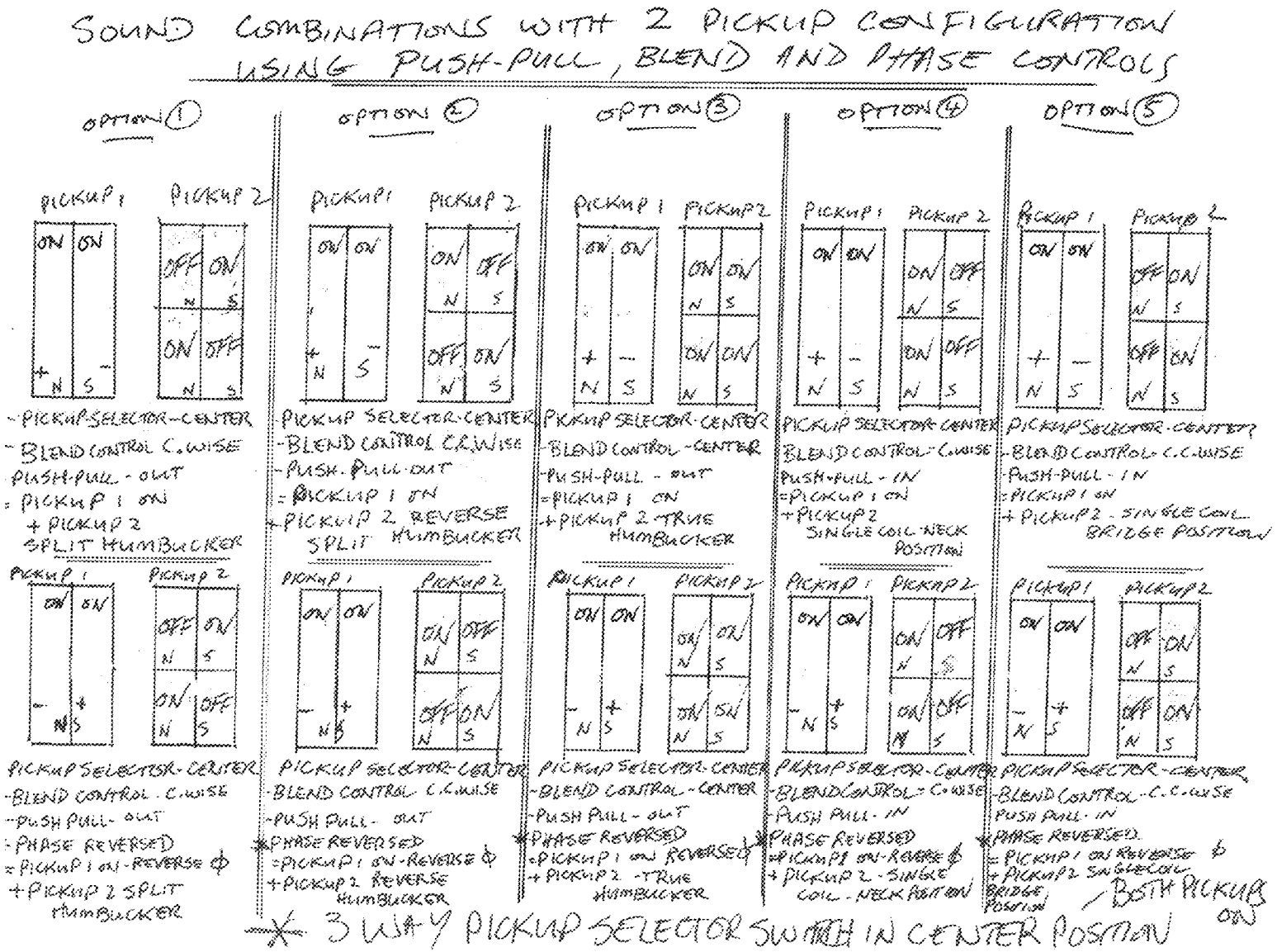
FIG. 17 is a diagram showing several varied options for the user due to arranging the magnetic coils in keeping with a four-string quad pickup plus standard dual-coil pickup combination such as shown in FIG. 14.

When combined with a matching dual coil humbucker with a phase switch, as shown in FIG. 14, the sound combinations number in the hundreds as diagrammed in FIGS. 15 through 17.

There should be no major damage to fit this pickup into the player's existing bass, as the shape the dimensions of the 'Quad" pickups are based on a very popular and widely used bass pickup.

Within each group of four (4) pole piece slugs, there are two (2) pairs of pole piece slugs, and each pair straddles one of the four (4) guitar strings to detect string vibrations and turn them into electrical pulses. The pole piece slugs are sandwiched between the top and bottom bobbins. Under the four (4) bottom bobbins are four (4) ceramic magnets, preferably on fiberboard or plastic, and, as shown in FIG. 3, are four (4) ceramic magnets. The four (4) ceramic magnets are touching the sixteen (16) pole piece slugs in order to create a magnetic circuit. Two of the ceramic magnets are sandwiched together around one Alnico 5 magnet with the opposing polarity holding them together and forming a super magnet of sorts.

As shown, the four (4) separate magnetic coils enable the four-string pickup assembly to generate at least five (5) different distinct sounds with the use of a push-pull switch and a rotary pan control. FIG. 3 shows the novel combinations of the four (4) magnetic coils to form multiple sound options using variable coil layout and numbering from the four-string quad pickup assembly. Such options include utilizing (1) a traditional precision bass sound employing coil 2 and coil 3 with an electrical resistance of 9.24 ohms; (2) a reverse precision bass sound employing the coil 1 and coil 4 with an electrical resistance of 9.24 ohms; (3) a single coil precision bass sound employing coil 1 and coil 2 with an electrical resistance of 9.24 ohms; (4) a single coil precision bass sound employing coil 3 and coil 4 with an electrical resistance of 9.24 ohms; and (5) an "all on" true pickup sound employing coil 1, coil 2, coil 3, and coil 4 with an electrical resistance of 18.37 ohms.

Figure 8:
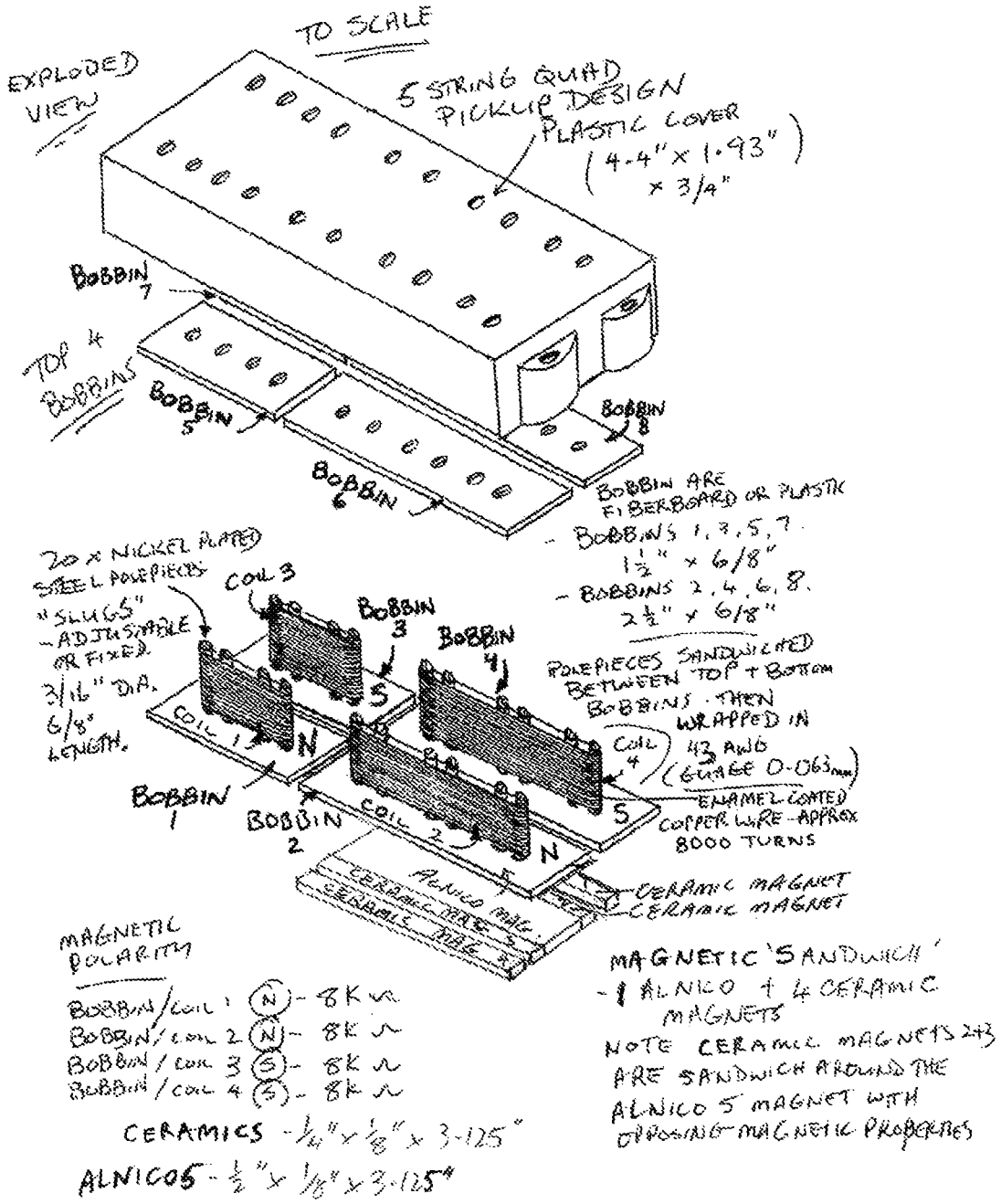
FIG. 8 is a diagram showing an exploded view of one embodiment of a five-string quad pickup of the present invention.
Figure 9:
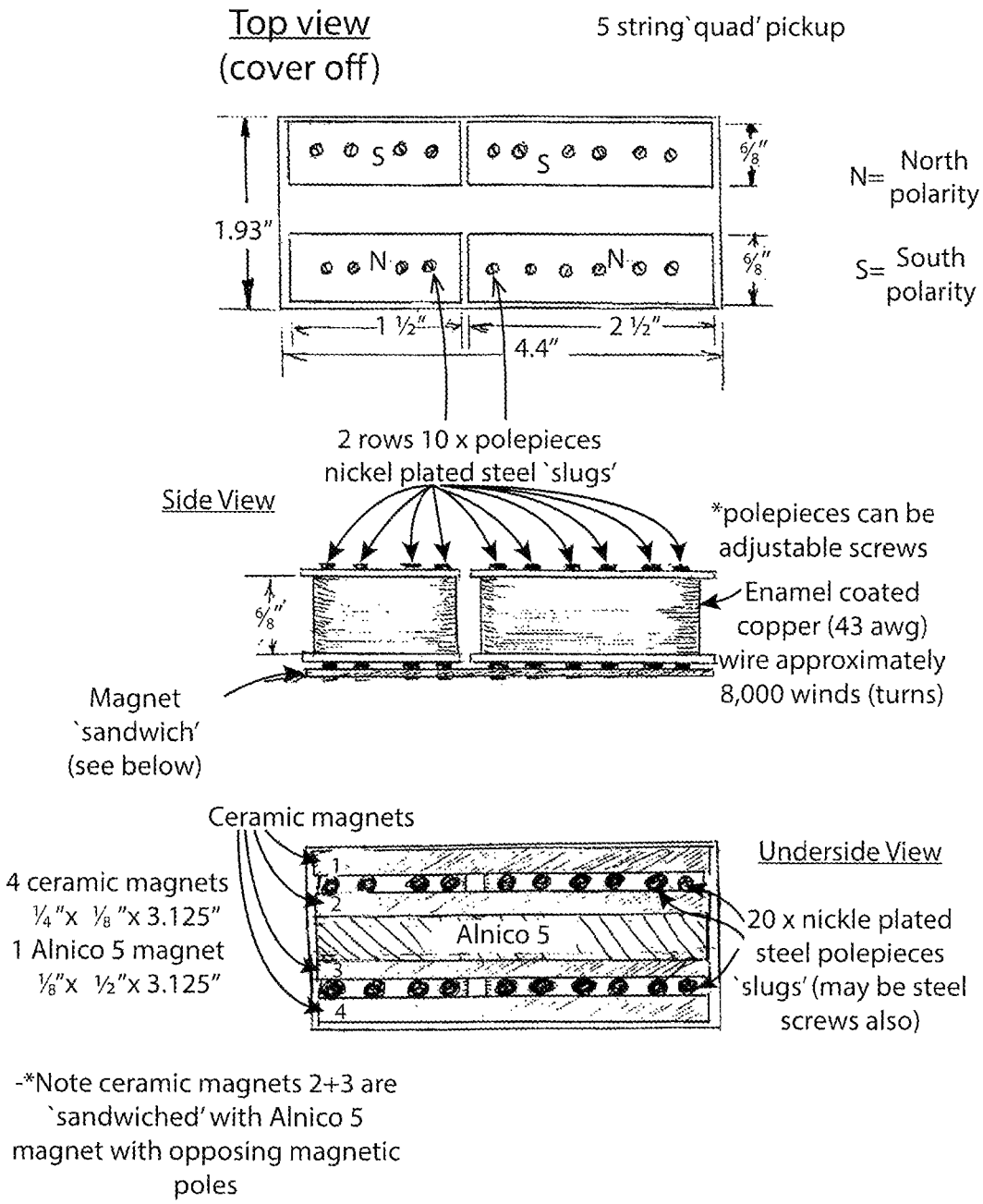
FIG. 9 is a diagram showing a top view of one embodiment of the five-string quad pickup of FIG. 8 with its plastic cover off, a side view of one embodiment of the five-string quad pickup of FIG. 8, and a bottom view of one embodiment of the five-string quad pickup of FIG. 8.

As mentioned above, the five-string quad pickup assembly is also constructed with the same methods and basic technical specifications as the four-string quad pickup assembly. Similar to the four-string quad pickup assembly, as shown in FIG. 8, the five-string quad pickup assembly comprises a cover, preferably plastic, covering four (4) top bobbins, preferably fiberboard or plastic. Twenty (20) pole piece slugs, preferably of nickel-plated steel and adjustable, are fitted on four (4) bottom bobbins. However, unlike the four-string quad pickup assembly, coil 2 and coil 4 wrap six (6) pole piece slugs each to accommodate three (3) strings, preferably base strings, and coil 1 and coil 3 wrap four (4) pole piece slugs each to accommodate two (2) strings. All coils are each wrapped in preferably 43 AWG (0.063 mm gauge) enamel coated copper wire, approximately 8,000 winds or turns with each bottom bobbin to provide approximately 9 K ohm resistance. Depicted in FIG. 4, coil 1 and coil 2 have a North magnetic polarity and coil 3 and coil 4 have a South magnetic polarity.

Within each group of four (4) or six (6) pole piece slugs, there are two (2) or three (3) pairs of pole piece slugs, respectively, and each pair straddles one of the five (5) guitar strings to detect string vibrations and turn them into electrical pulses. The pole piece slugs are sandwiched between the top and bottom bobbins. However, the dimensions of the top and bottom bobbins that sandwich coil 2 and 4 are different from the other top and bottom bobbins, with exemplary dimensions shown in FIG. 4. Under the four (4) bottom bobbins are four (4) ceramic magnets, preferably on fiberboard or plastic, and, as shown in FIG. 2, the four (4) ceramic magnets are touching the twenty (20) pole piece slugs in order to create a magnetic circuit. Two of the ceramic magnets are sandwiched together around one Alnico 5 magnet with the opposing polarity holding them together and forming a super magnet of sorts.

As shown, the four (4) separate magnetic coils enable the five-string pickup assembly to generate at least five (5) different distinct sounds. FIG. 10 shows the novel combinations of the four (4) magnetic coils to form multiple sound options using variable coil layout and numbering from the five-string quad pickup assembly. Such options include utilizing (1) a traditional precision bass sound employing coil 2 and coil 3 with an electrical resistance of 9.24 ohms; (2) a reverse precision bass sound employing the coil 1 and coil 4 with an electrical resistance of 9.24 ohms; (3) a single coil precision bass sound employing coil 1 and coil 2 with an electrical resistance of 9.24 ohms; (4) a single coil precision bass sound employing coil 3 and coil 4 with an electrical resistance of 9.24 ohms; and (5) an "all on" true pickup sound employing coil 1, coil 2, coil 3, and coil 4 with an electrical resistance of 18.37 ohms.

Figure 11:
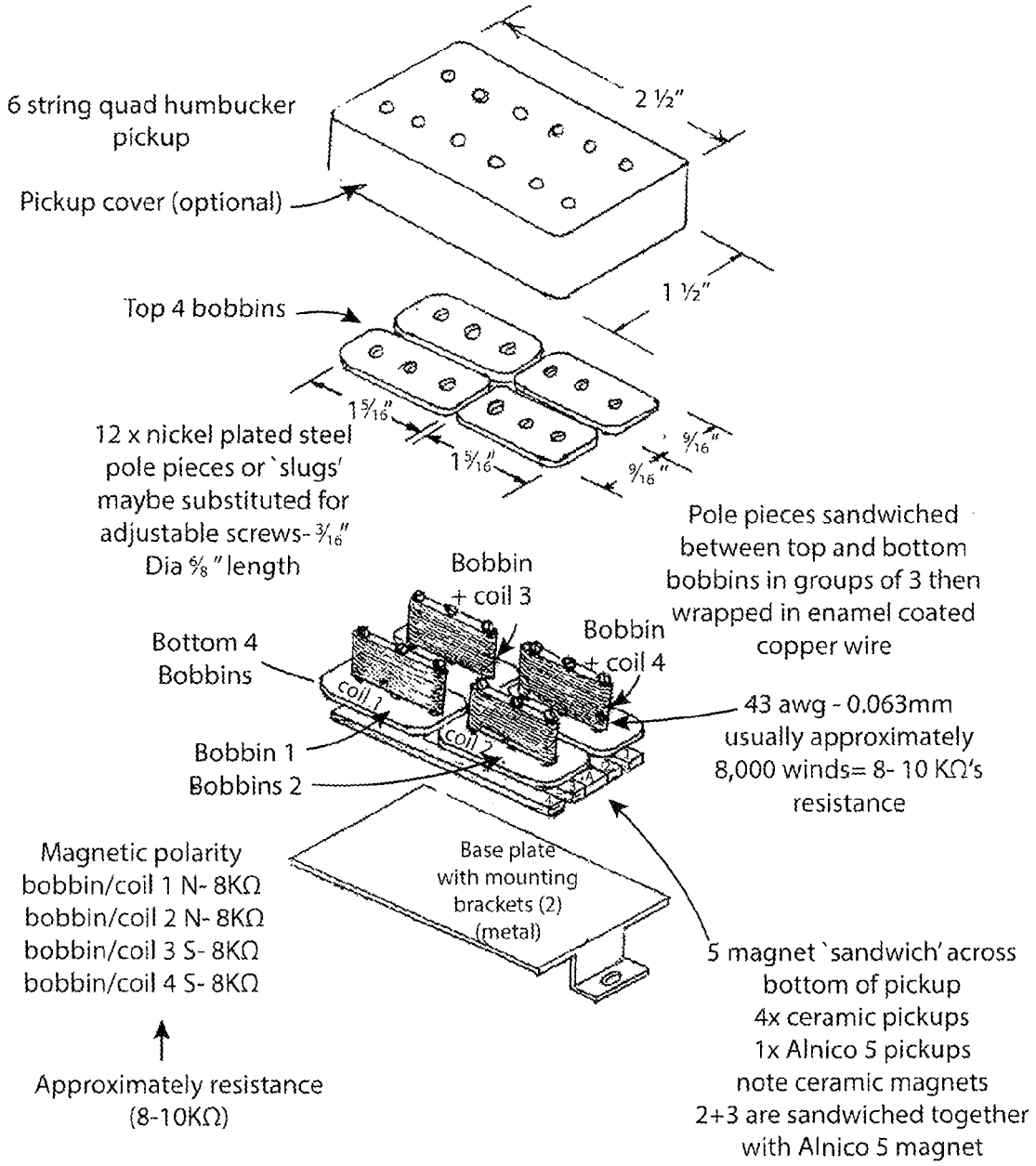
FIG. 11 is a diagram showing an exploded view of one embodiment of a six-string quad pickup of the present invention.

As mentioned above, the six-string quad pickup assembly is also constructed with the same methods and basic technical specifications as the four-string quad pickup assembly. Similar to the four-string quad pickup assembly, as shown in FIG. 11, the six-string quad pickup assembly comprises a cover, preferably plastic, covering four (4) top bobbins, preferably fiberboard or plastic. Twelve (12) pole piece slugs, preferably of nickel-plated steel and adjustable, are fitted on four bottom bobbins. However, unlike the four-string quad pickup assembly, all four (4) coils wrap six (6) pole piece slugs each to accommodate three (3) strings. All coils are each wrapped in preferably 43 AWG (0.063 mm gauge) enamel coated copper wire, approximately 8,000 winds or turns with each bottom bobbin to provide approximately 8K to 10K ohm of resistance. Depicted in FIG. 8, coil 1 and coil 2 have a North magnetic polarity and coil 3 and coil 4 have a South magnetic polarity.

Figure 12:
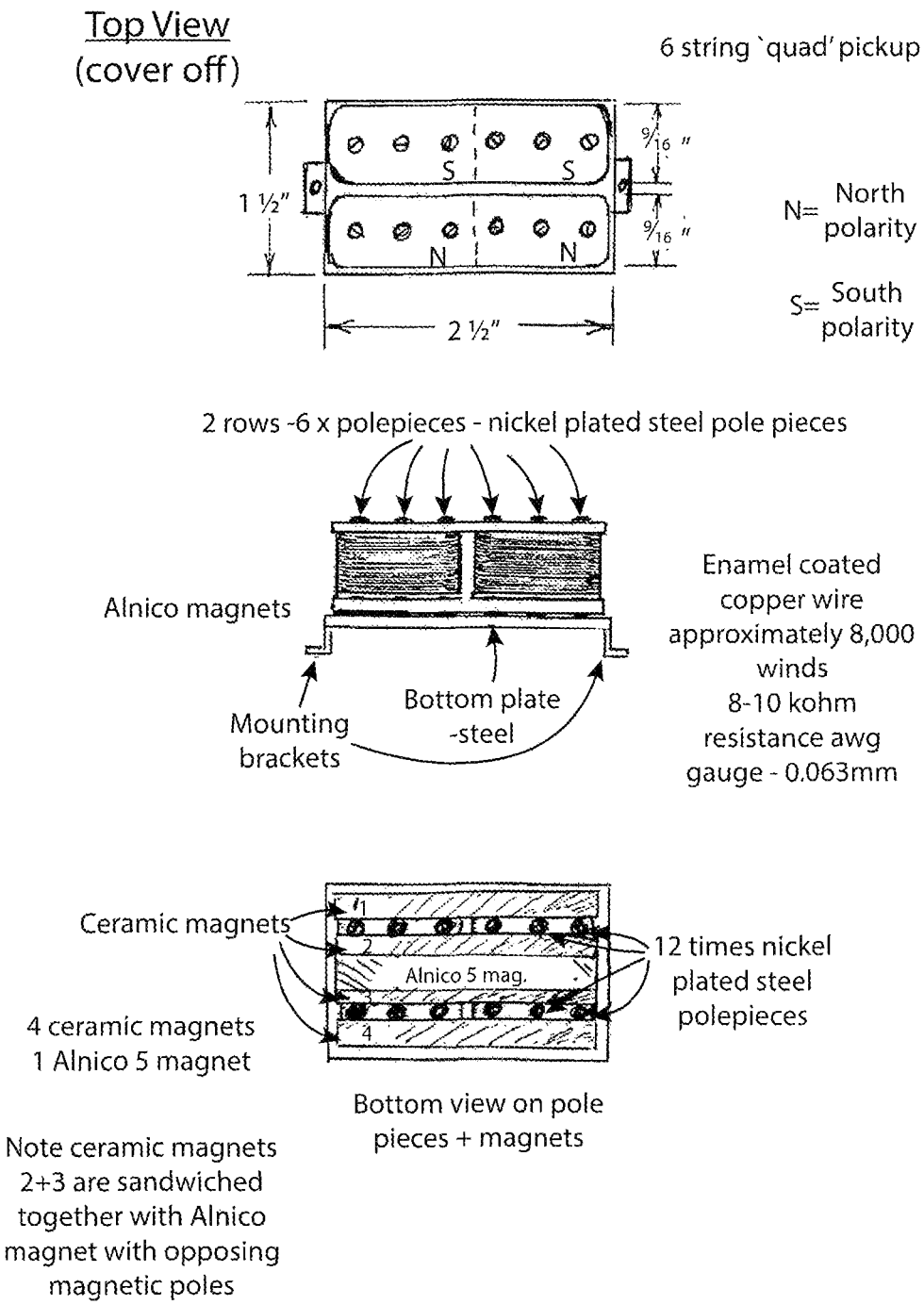
FIG. 12 is a diagram showing a top view of one embodiment of the six-string quad pickup of FIG. 11 with its plastic cover off, a side view of one embodiment of the six-string quad pickup of FIG. 11, and a bottom view of one embodiment of the six-string quad pickup of FIG. 11.

Within each group of three (3) pole piece slugs, each is directly under one of the six (6) guitar strings to detect string vibrations and turn them into electrical pulses. The pole piece slugs are sandwiched between the top and bottom bobbins. Under the four (4) bottom bobbins are four (4) ceramic magnets, preferably on fiberboard or plastic, and, as shown in FIGS. 11 and 12, the four (4) ceramic magnets are touching the twenty-four (24) pole piece slugs in order to create a magnetic circuit. Again, two of the ceramic magnets are sandwiched together around one Alnico 5 magnet with the opposing polarity holding them together and forming a super magnet of sorts. Under this magnet group, there is an attached base plate with two (2) metal brackets. Further, the plastic cover, ceramic, and Alnico magnets, and the attached base plate have different dimensions from that of the four-string and five-string quad pickup assembly.

Figure 13:
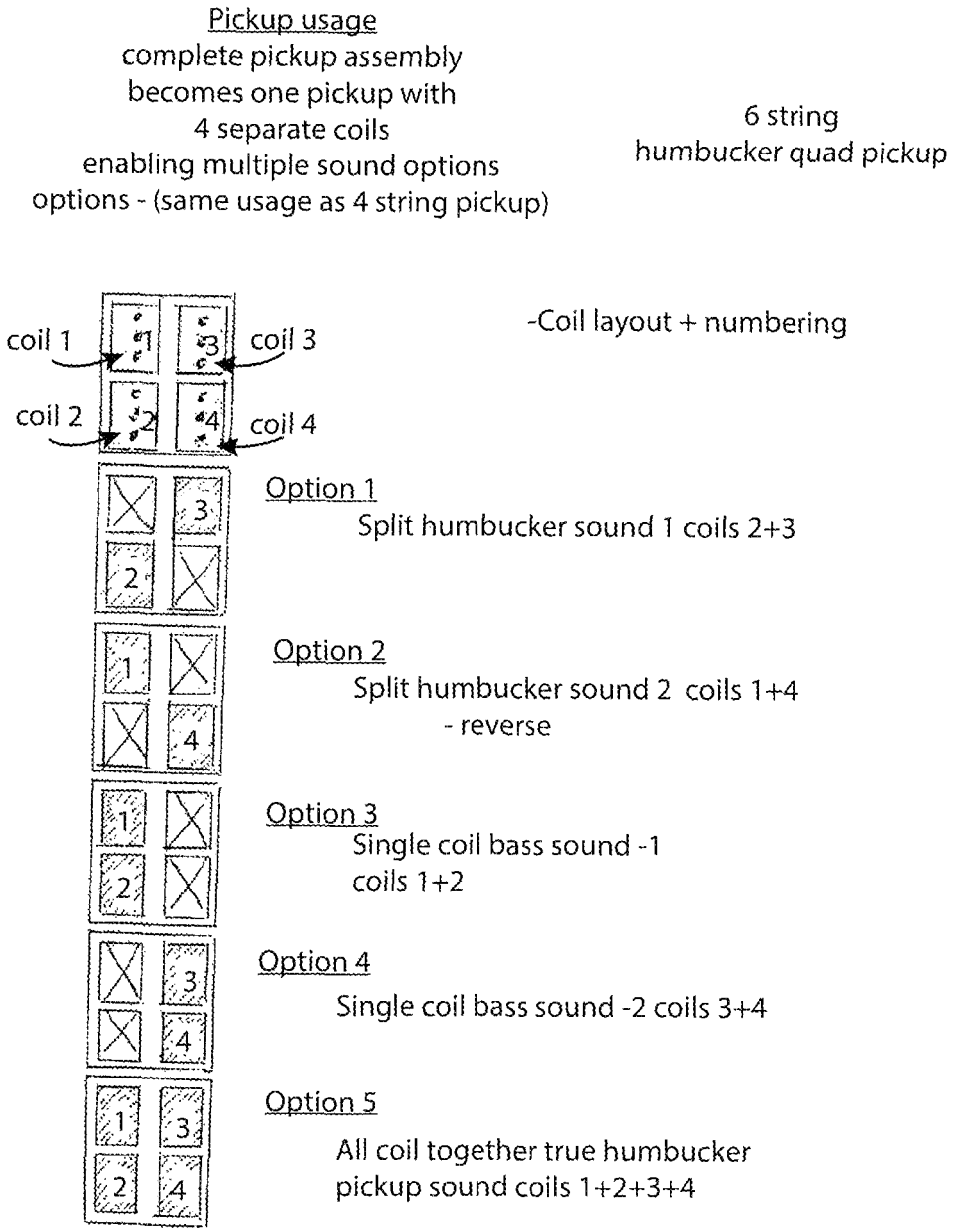
FIG. 13 is a diagram showing several varied options for the user due to arranging the magnetic coils in keeping with the four-string quad pickup of FIG. 11.

As shown, the four (4) separate magnetic coils enable the six-string pickup assembly to generate at least five (5) different distinct sounds. FIG. 13 shows the novel combinations of the four (4) magnetic coils to form multiple sound options using variable coil layout and numbering from the five-string quad pickup assembly. Such options include utilizing (1) a traditional split humbucker guitar sound employing coil 2 and coil 3 with an electrical resistance of 7.2 ohms; (2) a reverse split humbucker guitar sound employing coil 1 and coil 4 with an electrical resistance of 7.2 ohms; (3) a single coil guitar pickup sound employing coil 1 and coil 2 with an electrical resistance of 7.2 ohms; (4) a single coil guitar pickup sound employing coil 3 and coil 4 with an electrical resistance of 7.2 ohms; and (5) an "all on" true humbucker sound employing coil 1, coil 2, coil 3, and coil 4 with an electrical resistance of 14.4 ohms.

As mentioned above, the seven- and eight-string quad pickup assemblies are also constructed with the same methods and basic technical specifications as the four-, five-, and six-string quad pickup assemblies of the present invention. For example, the seven-string quad pickup assembly may comprise two (2) groups of six (6) and two (2) groups of eight (8) pole piece slugs, wherein there are three (3) or four (4) pairs of pole piece slugs, respectively, and each pair straddles one of the seven (7) guitar strings to detect string vibrations and turn them into electrical pulses.

Another example would be an eight-string quad pickup assembly comprising four (4) groups of eight (8) pole piece slugs, wherein there are sixteen (16) pairs of pole piece slugs, and each pair straddles one of the eight (8) guitar strings to detect string vibrations and turn them into electrical pulses.

For pickup assemblies applied to guitars with six or more strings, each string may have one pole piece slug directly under or straddled by a pair of pole piece slugs to detect string vibrations and turn them into electrical pulses. In addition, the pole piece slugs may be steel screws or a combination of nickel-plated steel pole piece slugs and steel screws. In any of the quad pickup up assemblies, the pole piece slugs may also be substituted with blade pickups.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

While the present invention has been described with regards to particular embodiments, it is recognized that additional variations of the present invention may be devised without departing from the inventive concept.

What is claimed is:

1. A pickup device for a guitar comprising four or more magnetic coils, with a first two such magnetic coils having a first polarity positioned beside a second two other such magnetic coils having a second polarity, each magnetic coil configured to produce electrical signals when placed in proximity of a vibrating guitar string, connected on one end by a combination of at least one AlNiCo 5 magnet sandwiched between at least two ceramic magnets matching north magnetic poles to south magnetic poles so that the polarity of said first two such magnetic coils is opposite the polarity of said second two such magnetic coils, and a selection means to incrementally select among said electrical signals produced by one or more of the four or more magnetic coils.

2. The pickup device of claim 1 wherein, the selection means is configured to rotate smoothly and continuously to allow for smooth continuous adjustment through a spectrum of magnetic coil configurations from one magnetic coil to all magnetic coils for providing a wide degree to selectivity between and among electrical signals produced by the magnetic coils.

3. The pickup device of claim 1 wherein, the magnetic coils are configured to operate passively and not require an active pre-amplifier and voltage supply to produce said electrical signals.

4. A pickup device for a guitar comprising four or more magnetic coils, with a first two such magnetic coils positioned beside a second two other such magnetic coils, each configured to produce electrical signals when placed in proximity of a vibrating guitar string and having at least 8000 winds each to provide sufficient resistance without the aid of a separate power source, and a selection means to incrementally select among said electrical signals produced by one or more of the four or more magnetic coils.

5. The pickup device of claim 4 wherein, the selection means is configured to rotate smoothly and continuously to allow for smooth continuous adjustment through a spectrum of magnetic coil configurations from one magnetic coil to all magnetic coils for providing a wide degree to selectivity between and among the electrical signals produced by the magnetic coils.

6. The pickup device of claim 4 wherein, the magnetic coils are configured operate passively and not to require an active pre-amplifier and voltage supply to produce said electrical signals.

* * * * *